US010006733B2

(12) United States Patent
Bender

(10) Patent No.: US 10,006,733 B2
(45) Date of Patent: Jun. 26, 2018

(54) NON-FOULING TRIGGER

(71) Applicant: Terrence Dwight Bender, Minneapolis, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days. days.

(21) Appl. No.: 14/919,886

(22) Filed: Oct. 22, 2015

(65) Prior Publication Data

US 2016/0131448 A1 May 12, 2016

Related U.S. Application Data

(60) Provisional application No. 62/067,210, filed on Oct. 22, 2014.

(51) Int. Cl.

| | |
|---|---|
| ***F41A 19/16*** | (2006.01) |
| ***F41A 19/10*** | (2006.01) |
| ***F41A 19/33*** | (2006.01) |
| ***F41A 19/46*** | (2006.01) |

(52) U.S. Cl.

CPC ..... *F41A 19/10* (2013.01); *F41A 19/16* (2013.01); *F41A 19/33* (2013.01); *F41A 19/46* (2013.01)

(58) Field of Classification Search

CPC ..... F41A 19/46; F41A 19/10; F41A 19/16; F41A 19/33

USPC ..... 89/142, 148

See application file for complete search history.

(56) References Cited

U.S. PATENT DOCUMENTS

| | | | | |
|---|---|---|---|---|
| 2,457,296 | A | 12/1948 | Yawman | |
| 2,920,413 | A | 1/1960 | Marhefka et al. | |
| 3,206,884 | A | 9/1965 | Purvis | |
| 3,768,190 | A | 10/1973 | Ruger et al. | |
| 4,004,496 | A * | 1/1977 | Snodgrass | F41A 19/02 89/129.02 |
| 4,005,540 | A | 2/1977 | Robinson | |
| 4,310,981 | A | 1/1982 | Waddell | |
| 4,433,610 | A * | 2/1984 | Tatro | F41A 19/44 89/148 |
| 4,667,429 | A | 5/1987 | Perazzi | |
| 4,680,884 | A | 7/1987 | Smith, Jr. et al. | |
| 4,691,461 | A | 9/1987 | Behlert | |
| 4,955,155 | A | 9/1990 | Jones | |
| 5,018,292 | A | 5/1991 | West | |
| 5,463,829 | A | 11/1995 | Sprangers | |

(Continued)

FOREIGN PATENT DOCUMENTS

DE 102007004588 B3 7/2008

OTHER PUBLICATIONS

Zediker, Glenn, AR15 Triggers, Zediker Publishing, 2007, pp. 1-3.

(Continued)

*Primary Examiner* — Stephen Johnson

(74) *Attorney, Agent, or Firm* — Vidas, Arrett & Steinkraus

(57) ABSTRACT

In some embodiments, a trigger comprises a sear surface, a trigger bow extending in a first direction, an arm extending in a second direction different from the first direction and an aperture arranged to receive a trigger pin. The arm comprises a cavity. A lower surface of the arm comprises an aperture in fluid communication with the cavity.

17 Claims, 5 Drawing Sheets

(56) References Cited

U.S. PATENT DOCUMENTS

| | | | | |
|---|---|---|---|---|
| 5,503,137 | A | 4/1996 | Fusco | |
| 5,548,914 | A | 8/1996 | Anderson | |
| 5,623,114 | A | 4/1997 | Soper | |
| 5,822,903 | A | 10/1998 | Davis, Sr. | |
| 5,881,485 | A | 3/1999 | Milazzo | |
| 5,904,132 | A | 5/1999 | Biller | |
| 6,164,001 | A | 12/2000 | Lee | |
| 6,298,594 | B1 | 10/2001 | Strayer | |
| 6,367,465 | B1 | 4/2002 | Buccieri, Jr. | |
| 6,615,527 | B1 | 9/2003 | Martin | |
| 6,651,642 | B1 | 11/2003 | Powers | |
| 6,772,072 | B2 | 8/2004 | Ganguli et al. | |
| 7,162,824 | B1 | 1/2007 | McCormick | |
| 7,188,561 | B1 | 3/2007 | Kelbly | |
| 7,293,385 | B2 | 11/2007 | McCormick | |
| 7,331,136 | B2 | 2/2008 | Geissele | |
| 7,600,338 | B2 | 10/2009 | Geissele | |
| 7,661,220 | B2 | 2/2010 | Crandall et al. | |
| 7,854,084 | B1 | 12/2010 | Rutherford | |
| 7,992,338 | B2 | 8/2011 | Bowman et al. | |
| 8,893,607 | B2 | 11/2014 | Audibert et al. | |
| 9,046,313 | B1 * | 6/2015 | Lutton | F41A 17/46 |
| 2003/0228915 | A1 | 12/2003 | Goko | |
| 2005/0229911 | A1 | 10/2005 | Simo et al. | |
| 2006/0207149 | A1 | 9/2006 | Lazor | |
| 2008/0010889 | A1 | 1/2008 | Metzger et al. | |
| 2009/0183414 | A1 | 7/2009 | Geissele | |
| 2009/0266348 | A1 | 10/2009 | Yeh | |
| 2010/0281739 | A1 | 11/2010 | Geissele | |
| 2011/0167691 | A1 | 7/2011 | Bowman et al. | |
| 2011/0167697 | A1 | 7/2011 | Geissele | |
| 2012/0117841 | A1 | 5/2012 | Joubert et al. | |
| 2013/0047484 | A1 | 2/2013 | Wickser, Jr. | |
| 2013/0118050 | A1 * | 5/2013 | Alicea | F41A 17/06 42/84 |
| 2013/0167423 | A1 | 7/2013 | Lupher et al. | |
| 2013/0213376 | A1 | 8/2013 | Kenworthy | |
| 2013/0269233 | A1 | 10/2013 | Chin | |
| 2014/0366418 | A1 * | 12/2014 | Stakes | F41A 19/10 42/69.03 |
| 2016/0018176 | A1 * | 1/2016 | Fellows | F41A 19/02 42/69.03 |

OTHER PUBLICATIONS http://www.snipershide.com/forum/ubbthreads.
php?ubb+showthreaded&Number=501733, Jan. 26, 2012.
http://www.compasslake.com/trigger.htm, Jan. 26, 2012.
http://www.jprifles.com/1.4.8.1_ezt.php, Jan. 26, 2012.
http://cmmginc.secure-mall.com/item/CMMG-Two-Stage-Trigger-1504, Jan. 26, 2012.
http://shopwilsoncombat.com/Tactical-Trigger-Unit-Single-Stage-Semi-Auto/productinfo/TR-TTU/
?gclid=CP6b79SY8aYCFYQUKgodTRRBBg, Jan. 26, 2012.
http://geissele.com/index.aspx, Jan. 26, 2012.
http://www.midwayusa.com/product/709049/jewell-trigger-assembly-ar-15-small-pin-154-two-stage-matte, Jan. 26, 2012.
http://www.jardinc.com/index.php?option=com_content
&view=article&id=12:ar-le&catid=18:ar-15-single-stage
&Itemid=6, Jan. 26, 2012.
Schematic drawing, Gun Assy, BFG-50A, Serbu Firearms, Inc., Apr. 25, 2011, p. 1.

* cited by examiner

NON-FOULING TRIGGER

CROSS-REFERENCE TO RELATED APPLICATIONS

This application claims the benefit of U.S. Patent Application No. 62/067,210, filed Oct. 22, 2014, the entire content of which is hereby incorporated herein by reference.

BACKGROUND OF THE INVENTION

This invention relates generally to firearms and more specifically to triggers used in firearms.

Many modern sporting rifles utilize direct gas impingement to eject a spent cartridge and to re-cock the rifle. Typically upon firing, propellant gas expands and is used to provide the force that propels the bullet. A portion of the propellant gas is tapped and routed to pressurize a cylinder piston arranged in the bolt carrier. The gas pressure unlocks the bolt and causes the bolt and bolt carrier to cycle, thereby ejecting the spent cartridge. In general, a spring is used to return the bolt carrier to its previous position. As the bolt carrier returns, a new cartridge is loaded and the gun becomes ready to fire. The process can then repeat.

Over time and under general use, carbon fouling can build in and around the propellant gas passageways. Fouling is often more pronounced in guns that utilize a short barrel and/or suppressors. Some fire-control groups will cease to operate after only 100 rounds under short barrel/suppressed fire due to carbon buildup. This build up prevents normal operation of the semi-auto disconnector.

Another type of fouling is not caused by propellant exhaust, but is related to other types of debris, such as blown primer cups, sand or other small particulates. Such debris can enter a rifle (e.g. through an ejection port) and cause the rifle to jam.

Spent propellant exhaust and particulate debris can cause two types of malfunctions. In a first case, fouling or debris can fall into a cavity in a trigger that receives a semi-auto disconnector. The fouling/debris can impede movement of the disconnector with respect to the trigger, eventually preventing the disconnector from rotating, preventing adequate hammer capture or hammer reset, etc.

In a second case, fouling/debris can collect under a rear portion of the trigger, for example between the trigger and its housing. Movement of the trigger can be impeded such that the hammer cannot reset.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a trigger comprises a trigger bow, a sear surface, an arm, a safety contacting portion and defines a pivot axis. The arm comprises a first sidewall and a second sidewall defining a slot therebetween. A lower surface of the arm comprises an aperture in fluid communication with the slot.

In some embodiments, a trigger comprises a sear surface, a trigger bow extending in a first direction, an arm extending in a second direction different from the first direction and an aperture arranged to receive a trigger pin. The arm comprises a cavity. A lower surface of the arm comprises an aperture in fluid communication with the cavity.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
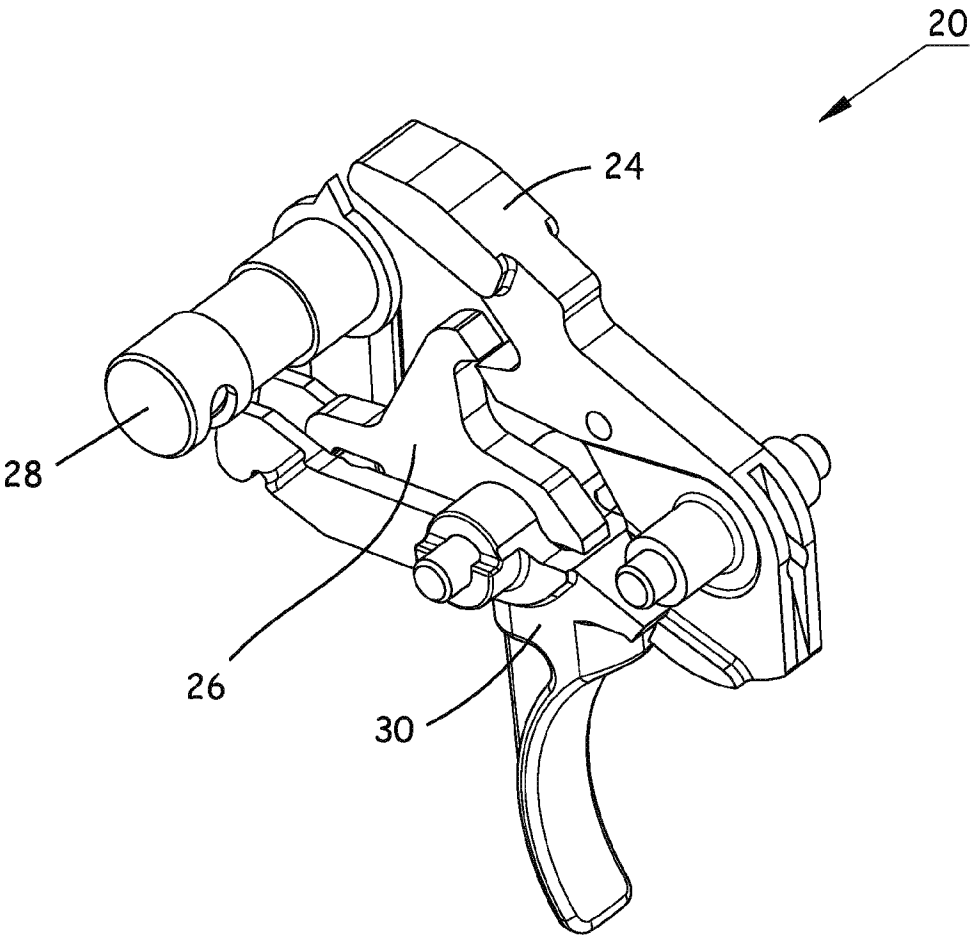
FIG. 1 shows an embodiment of a trigger group.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a trigger group 20. In some embodiments, the trigger group 20 is constructed and arranged to be used in an AR lower receiver. In some embodiments, portions of the trigger group 20 include potions as described in U.S. Pat. No. 8,572,880, the entire disclosure of which is hereby incorporated herein by reference.

In some embodiments, the trigger group 20 comprises a hammer 24, a disconnector 26, a safety selector 28 and a trigger 30.

Figure 3:
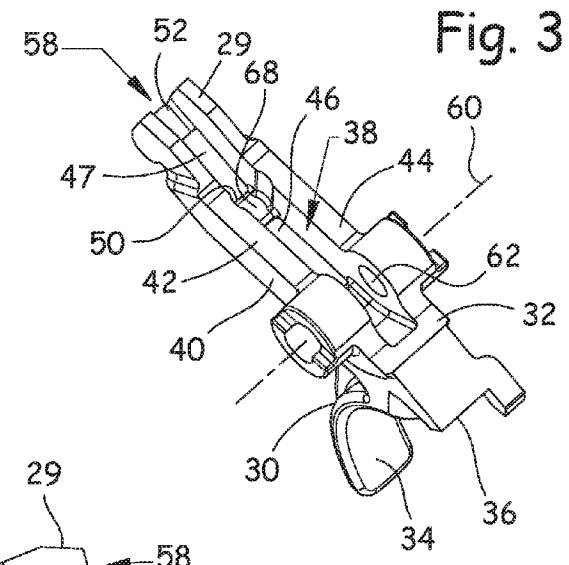
FIGS. 2-4 show different views of an embodiment of a trigger.
Figure 2:
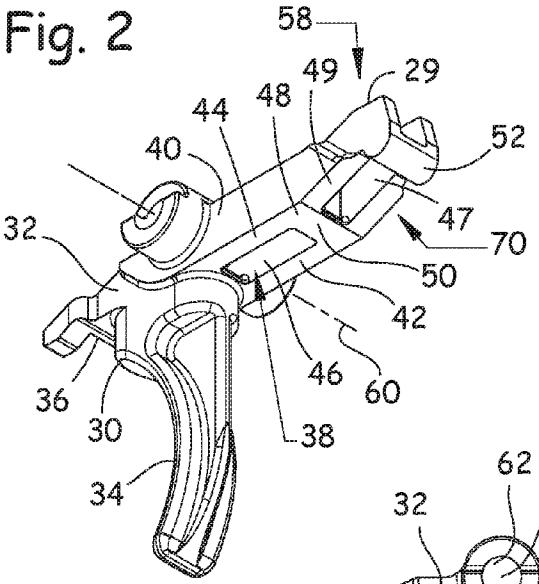
Figure 4:
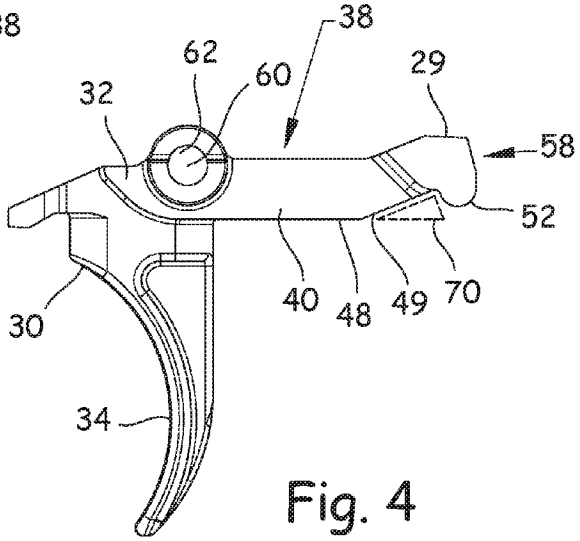

FIGS. 2-4 show an embodiment of a trigger 30. Desirably, the trigger 30 is configured for rotation about an axis 60. In some embodiments, the trigger 30 defines one or more apertures 62 along the axis 60, for example to receive a trigger pin.

In some embodiments, the trigger 30 comprises a body portion 32, a trigger bow having a finger portion 34, a sear 36 and a safety contacting portion 29. A finger portion 34 can be actuated by a shooter, causing a rifle to fire. The sear 36 is desirably arranged to contact the hammer 24. The safety contacting portion 29 is desirably arranged to contact the safety selector 28 in some configurations, for example when the rifle is in safe mode.

Desirably, the trigger 30 comprises an arm 40 that extends to the safety contacting portion 29. The sear surface 36 and the arm 40 can be located on opposite sides of the trigger bow 34. Desirably, the arm 40 provides for a clearance area 70 in a lower distal portion of the arm 40, for example by omitting structure. In some embodiments, a clearance area 70 is provided beneath the safety contacting portion 29.

In some embodiments, the arm 40 comprises a first portion 48 and a second portion 49, wherein the first portion 48 is oriented at an angle to the second portion 49. In some embodiments, each portion 48, 49 is straight. In some embodiments, the first portion 48 extends from the finger portion 34 rearward. In some embodiments, the second portion 49 bounds the clearance area 70. In some embodiments, a distance between the second portion 49 and a surrounding housing increases as the second portion 49 is traversed in a direction away from the first portion 48. In some embodiments, at least a portion of the second portion 49 is oriented beneath the safety contacting portion 29.

In some embodiments, at least a portion of a lower surface of the arm 40 comprises a curved or angled portion that provides for the clearance area 70. In some embodiments, a distance between the lower surface of the arm 40 and a surrounding housing increases as the lower surface of the arm 40 is traversed in a direction away from the finger portion 34.

In some embodiments, the trigger 30 arm 40 comprises a first frame member 42 and a second frame member 44. In some embodiments, the shape of the first frame member 42 comprises a mirror image of the shape of the second frame member 44. In some embodiments, each frame member 42, 44 is shaped to provide the clearance area 70. In some embodiments, the first frame member 42 comprises a first sidewall of the arm 40 and the second frame member 44 comprises a second sidewall of the arm 40.

In some embodiments, the trigger 30 defines a slot 38 arranged to receive a portion of the disconnector 26. In some embodiments, the slot 38 is defined by the first and second frame members 42, 44.

In some embodiments, the trigger 30 is arranged to receive a spring oriented between the trigger 30 and the disconnector 26. In some embodiments, the trigger 30 arm 40 comprises a seat 68 arranged to receive the spring. In some embodiments, the first and second frame members 42, 44 each comprise arcuate cutouts located adjacent to the seat 68, and define a spring cavity.

In some embodiments, the trigger 30 arm 40 comprises a bridge member 50 attached between the first and second frame members 42, 44. In some embodiments, the bridge member 50 comprises the seat 68.

In some embodiments, a bridge member 50 comprises a portion of a lower surface of the arm 40, and a first aperture 46 is defined in the lower surface of the arm 40. In some embodiments, the bridge member 50 can be raised from its position as shown in FIG. 2, such that the bridge member 50 is not flush with a lower surface of the arm 40.

In some embodiments, the slot 38 continues distal to the bridge member 50, and a lower surface of the arm 40 defines a second aperture 47 that allows fluid communication between the slot 38 and the clearance area 70.

In some embodiments, a distal portion 58 of the arm 40 is reduced in width. In some embodiments, a distal portion 58 of each of the first and second frame members 42, 44 is reduced in width.

In some embodiments, the arm 40 comprises a connecting member 52 attached between the first and second frame members 42, 44. A connecting member 52 can add strength. In some embodiments, a connecting member 52 comprises an arcuate portion. In some embodiments, a connecting member 52 comprises a substantially cylindrical portion. In some embodiments, a connecting member 52 defines a portion of a lower surface of the arm 40. In some embodiments, a connecting member 52 is located in the distal portion 58 of the arm 40.

In some embodiments, a connecting member 52 is located adjacent to the clearance area 70. A connecting member 52 can be considered a second bridge.

Figure 5:
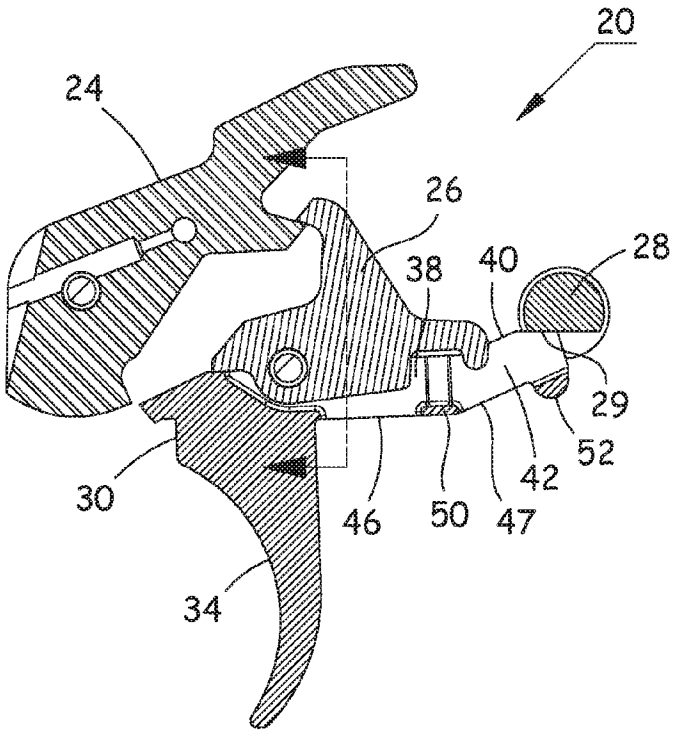
FIG. 5 shows a side view of an embodiment of a trigger group.

FIG. 5 shows an embodiment of a trigger group 20 having a trigger 30 as herein described, wherein the trigger 30 and disconnector 26 are visible. As the various components of the trigger group 20 move, fouling and debris can clear via the apertures 46, 47 in the lower surface of the arm 40. This prevents the fouling/debris from impeding movement of the disconnector 26 with respect to the trigger 30.

Figure 6:
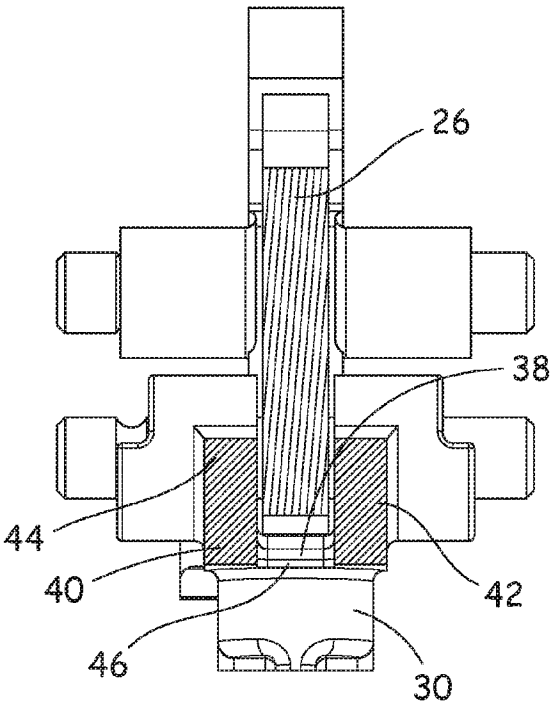
FIG. 6 shows a cross-sectional view taken along the section line shown in FIG. 5.

FIG. 6 shows a cross-sectional view taken along the section line shown in FIG. 5.

Figure 7:
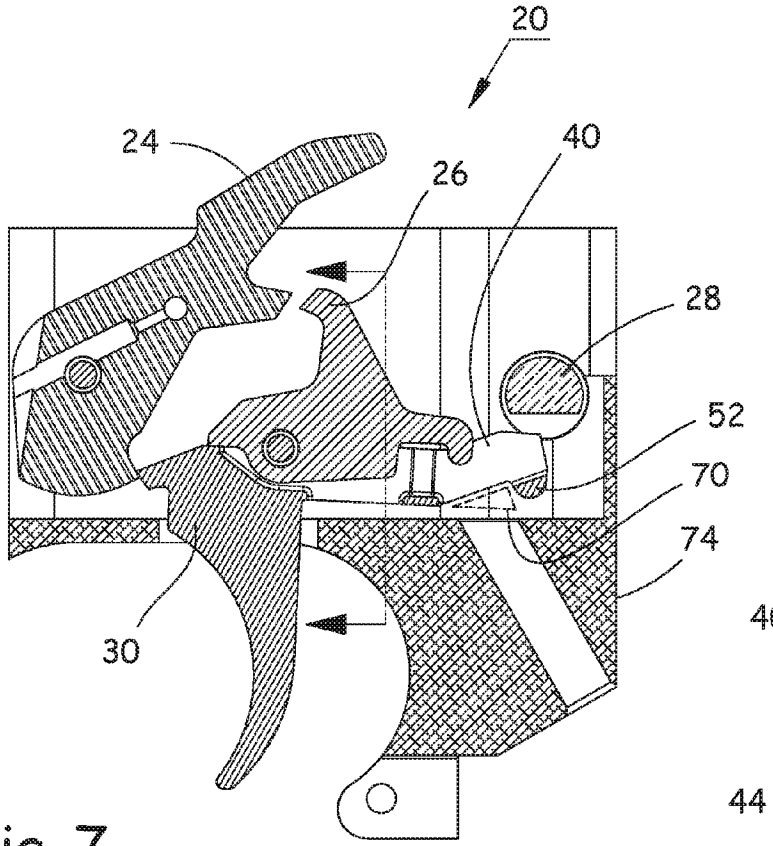
FIG. 7 shows a side view of an embodiment of a trigger group oriented in a housing.

FIG. 7 shows an embodiment of a trigger group 20 installed in a housing 74, such as an AR lower receiver. FIG. 7 shows how the shape of the arm 40 of the trigger 30 provides for a clearance area 70 between the trigger 30 and the housing 74. The shape of the arm 40 helps to prevent fouling/debris located between the trigger 30 and the housing 74 from impeding movement of the trigger 30.

In some embodiments, a connecting member 52 and/or a lower portion of the arm 40 defines a curved, arcuate or tapered shape. FIG. 7 shows a connecting member 52 having an arcuate lower surface. The shape of the lower surface of the connecting member 52 will help push fouling/debris forward or rear of the connecting member 52 and prevent the fouling/debris from impeding movement of the trigger 30.

Figure 8:
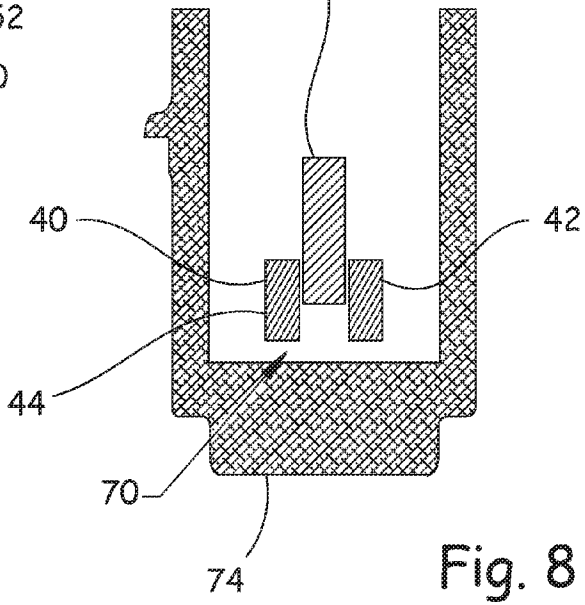
FIG. 8 shows a cross-sectional view taken along the section line shown in FIG. 7.

FIG. 8 shows a cross-sectional view taken along the section line shown in FIG. 7.

Figure 9:
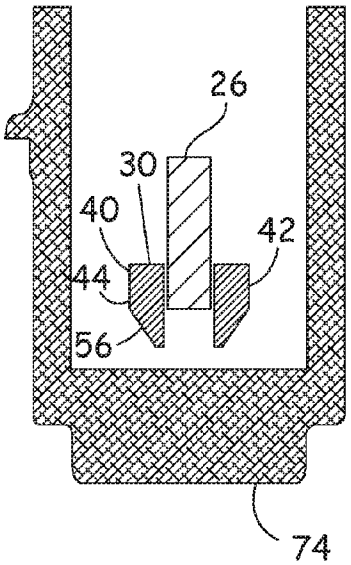
FIGS. 9-11 each show an embodiment of a trigger positioned in a housing.
Figure 10:
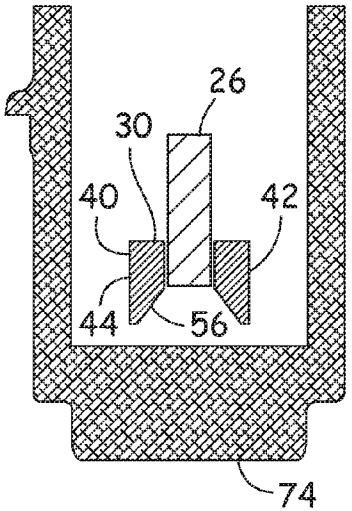
Figure 11:
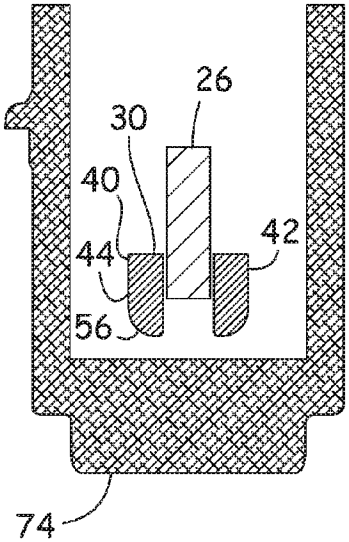

FIGS. 9-11 each show a view similar to that of FIG. 8, but illustrate alternative embodiments of a trigger 30. In some embodiments, a lower surface of the trigger 30 arm 40 comprises a tapered portion 56. In some embodiments, a lower surface of each of the first and second frame members 42, 44 comprises a tapered portion 56. In some embodiments, a tapered frame member 42, 44 reduces in width as the frame member 42, 44 is traversed in a direction toward the lower surface of the arm 40. A tapered shape will help to clear fouling/debris located between the trigger 30 and the housing 74.

In some embodiments, at least a portion of the connecting member 52 shown in FIGS. 2 and 3 can be omitted or removed. Embodiments of a trigger 30 suitable for use in a full auto arrangement may omit the connecting member 52.

In some embodiments, the trigger 30 comprises at least one aperture 46 that provides for fluid communication between an area above the trigger 30 and an area below the trigger 30. In some embodiments, the trigger 30 comprises at least one aperture 46 that provides for fluid communication between a slot 38 defined in the trigger 30 and an area located between a lower surface of the trigger 30 and a housing surrounding the trigger 30.

The trigger group 20 disclosed herein can be used in any suitable type of firearm. In some embodiments, the trigger group 20 is configured for use in an AR lower receiver, for example having a hammer pin and trigger pin at appropriate orientations and be sized to fit in a cavity provided by an AR lower receiver. In some embodiments, a trigger group 20 can be constructed and arranged for use in a Bushmaster ACR rifle, an FN SCAR rifle, etc.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A trigger comprising:

a body defining a pivot axis, the body comprising a trigger bow, a sear surface, an arm and a safety contacting portion, the sear surface and the arm positioned on opposite sides of the pivot axis;

the arm comprising a first sidewall and a second sidewall defining a slot therebetween, a lower surface of the arm defining an aperture in fluid communication with the slot, the arm comprising a bridge extending between the first sidewall and the second sidewall; and a disconnector and a disconnector spring, the disconnector spring contacting said bridge.

2. The trigger of claim 1, wherein the lower surface comprises a first portion and a second portion, the first portion oriented at an angle to the second portion.

3. The trigger of claim 2, wherein the aperture is formed in the second portion.

4. The trigger of claim 1, wherein the aperture is located in a length portion of the arm that is positioned between the bridge and the pivot axis.

5. The trigger of claim 1, wherein the bridge is directly adjacent to the aperture.

6. The trigger of claim 1, wherein the lower surface defines a second aperture.

7. The trigger of claim 6, wherein the aperture and the second aperture are positioned on opposite sides of the bridge.

8. The trigger of claim 1, the arm comprising a second bridge extending between the first sidewall and the second sidewall, the bridge and the second bridge positioned on opposite sides of the aperture.

9. The trigger of claim 1, wherein the lower surface comprises curvature.

10. The trigger of claim 1, the body comprising an aperture that surrounds the pivot axis.

11. The trigger of claim 1, the first sidewall being tapered.

12. The trigger of claim 11, the second sidewall being tapered.

13. The trigger of claim 1, wherein safety contacting portion is located on the arm.

14. A trigger comprising:

a body having an aperture arranged to receive a trigger pin, the body comprising a sear surface, a trigger bow extending in a first direction and an arm extending in a second direction different from the first direction, the sear surface and the arm located on opposite sides of the trigger bow, the arm comprising a first sidewall and a second sidewall defining a cavity, a lower surface of the arm comprising a first portion and a second portion, the first portion defining a first aperture in fluid communication with the cavity and the second portion defining a second aperture in fluid communication with the cavity, the arm comprising a bridge extending between the first sidewall and the second sidewall, the bridge positioned between the first aperture and the second aperture; and a disconnector and a disconnector spring, the disconnector spring contacting the bridge.

15. The trigger of claim 14, the arm comprising a second bridge extending between the first sidewall and the second sidewall, the second bridge positioned adjacent the second aperture.

16. The trigger of claim 14, wherein the first aperture is located in a length portion of the arm that is positioned between the bridge and the trigger pin aperture.

17. The trigger of claim 14, wherein the first portion is oriented at an angle to the second portion.

* * * * *